US005265884A

United States Patent [19]

Kaplan

[11] Patent Number: 5,265,884

[45] Date of Patent: Nov. 30, 1993

[54] MAGNET TOSS GAME

[76] Inventor: David Stein, 306 W. 106 St., 3F, New York, N.Y. 10025

[21] Appl. No.: 776,612

[22] Filed: Oct. 15, 1991

[51] Int. Cl.[5] ..... A63F 9/00

[52] U.S. Cl. ..... 273/345; 273/450; 273/400

[58] Field of Search ..... 273/400, 443, 448, 450, 273/456, 459, 345, 126 A, 239, 290, 353; 434/301; 446/129, 137

[56] References Cited

U.S. PATENT DOCUMENTS 712,159 10/1962 Voege ..... 273/400
4,902,201 2/1990 Seaton ..... 273/456 X
5,072,936 12/1991 Warehime ..... 273/450

*Primary Examiner*—William H. Grieb
*Attorney, Agent, or Firm*—Gottlieb, Rackman & Reisman

[57] ABSTRACT

This invention discloses a game of skill which brings into play the delightful and astonishing behavior of round rolling magnets. Players take turns tossing disc-shaped magnets into a cylindrical cup. The magnets gradually begin to stack up inside the cup, and eventually pile up above the rim to form a growing tower. The object is always to add a magnet to the stack without overturning the cup or the tower. Inevitably, the tower finally crashes down, and another round of the game begins.

3 Claims, 1 Drawing Sheet

MAGNET TOSS GAME

Figure 1:
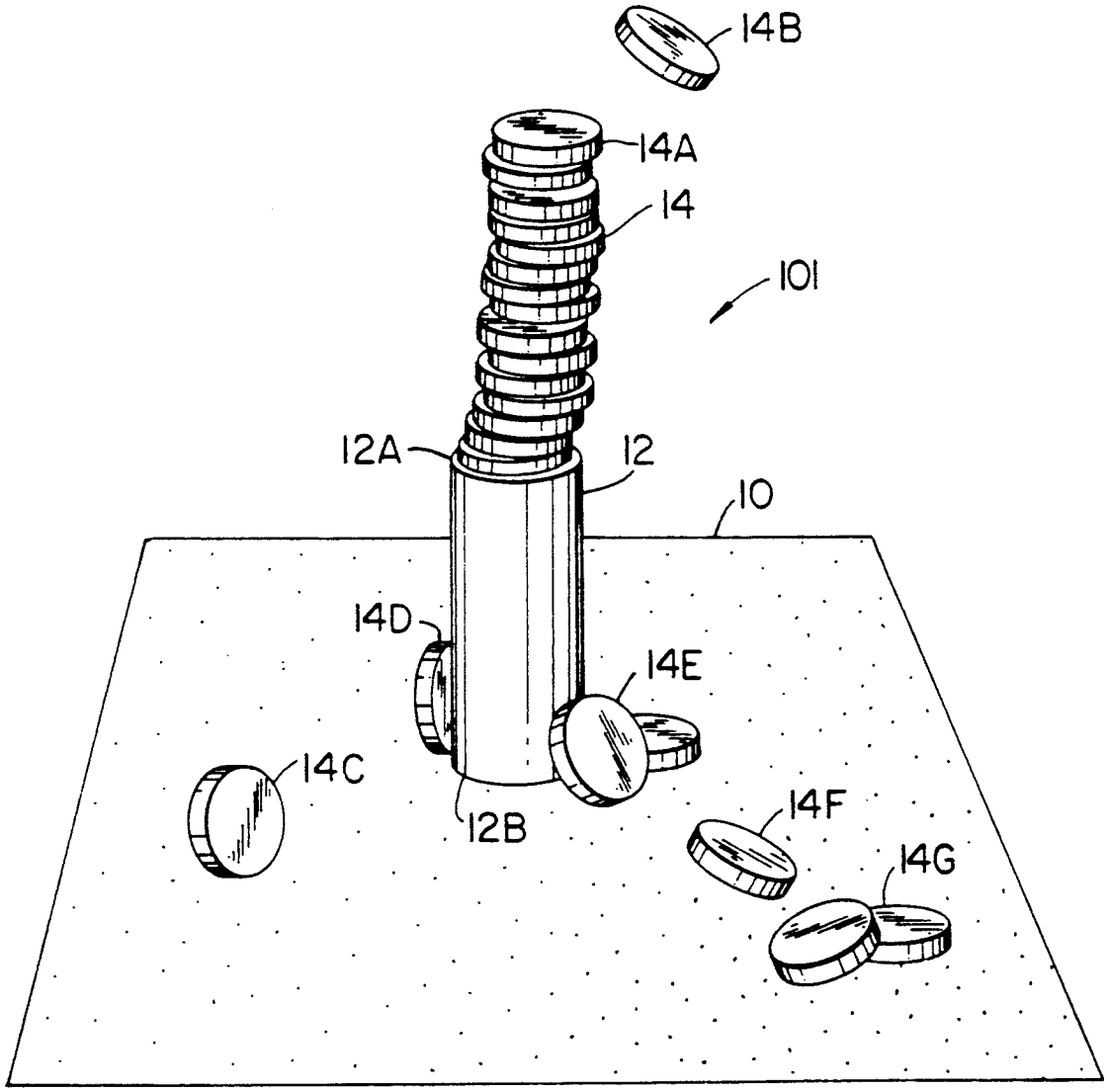

This invention relates to a fast-moving game of skill which brings into play the delightful behavior of round rolling magnets. The basic equipment comprises: a plurality of magnets about the size and shape of a checker; a textured playing surface such as a rough cloth able to slow the movement of magnets sliding or rolling upon it; and a cylindrical cup, slightly wider in diameter than the magnets. During play, the cup is placed on the textured surface, and the players take turns attempting to toss magnets into the cup without overturning it. Magnets landing in the cup adhere magnetically to one another, and after a while a tower of magnets begins growing out of the cup. The players continue trying to toss magnets onto the tower, adding to it without overturning it. Ultimately one player overturns the tower, losing one round of several in the game.

DEFINITIONS

"Disc-shaped" is meant to include polygonal forms, although the preferred embodiment herein is round.

"Cup" is meant to include any open vessel adaptable to the game described, although the preferred embodiment herein is cylindrical.

OBJECTS OF THE INVENTION

The first object of this invention is to provide a game whose delight springs from the special qualities of round rolling magnets. Said qualities include the ability to roll, to repel or attract one another, to influence one another's motion at a distance, and to adhere in structures which seemingly defy gravity.

A second object is to provide a game which is inexpensive to manufacture, compact to package, easy to learn, safe to use, and attractive to hand and eye.

PRIOR ART

The checker-shaped magnets and rough playing surface of this invention are very similar to those described in U.S. Pat. No. 4,902,011, issued to Seaton in 1990. Extreme concentration is required in Seaton's game to balance one magnetic checker on the field of another in the manner disclosed. It is a slow, serious game in which skillful concentration is the main interest.

The present invention adds a simple cylindrical cup to the apparatus, and discloses a method of play wherein players take turns tossing magnets in the cup to form a learning tower. In contrast to Seaton's game, this one is three-dimensional, fast-moving, and dynamic, with pieces always tossing through the air, or rolling across the playing surface, doing strange magnetic flips and turns as if by magic. The game is full of surprises. There is suspense as the tower grows, and an explosive release of laughter as it topples.

APPARATUS AND METHOD OF PLAY

FIG. 1 shows a preferred embodiment of game 101, comprising a rough playing surface 10, a cylindrical cup 12, having a rim 12A and a base 12B, and a number of disc-shaped magnets 14. Surface 10 can be any material providing sufficient texture to slow the movement of magnets 14 rolling or sliding across it. Cup 12 can be of plastic, metal, or any other suitable material, and might vary in its dimensions and proportions, so long as the inside diameter of the cup is larger than the diameter of magnets 14. The size, proportions, and exact design of magnets 14 might vary from the one shown. The magnets might be cast of a homogeneous material, or assembled of several materials, for example a magnetic plug inset in a wider plastic disk, as function and cost allow.

Play begins by placing empty cup 12 in the center of surface 10. Magnets 14 are divided among the players. The players then take turns trying to toss a magnet into cup 12 without overturning it. After a few rounds, a player will succeed in landing a magnet in cup 12. As several more magnets 14 accumulate in the cup, their weight begins to stabilize it, making the cup progressively harder to overturn. The accumulating stack of magnets align their magnetic fields to form an increasingly powerful combined magnet.

After a while, the stack of magnets 14 rises above cup rim 12A and begins growing to form a tower as shown in the drawing. The taller the tower grows, the stronger the composite magnetism becomes. The tower will easily catch another magnet 14B tossed towards it. In fact, the incoming magnet 14B will do the most surprising and amusing aerial acrobatics in order to land on and join the tower.

The behavior of magnets 14 which miss landing on the tower is equally amusing. A magnet such as 14C may land rolling. Depending on its path, it may bump against cup base 12B, where it magnetically may flip around and join base B with a snap. Or it may become part of a growing agglomeration of magnets like 14E around base 12B. A tossed or rolling magnet such as 14F may also flip round and snap together with an outlying agglomeration of magnets 14G.

In general, the game brings into play all the delightful qualities and surprising behavior of round rolling magnets. Because tower of magnets 14A is inevitably tilting, each round of the game ends with a great crash as the tower topples, and magnets roll every which way, flipping, turning, and forming amusing agglomerations. As the players separate the magnets to begin another round, the magnets shift surprisingly around some more, both on the playing surface and in the player's hands.

One simple method of keeping score is to grant one point to a player when he adds a magnet to the cup or to the tower, and to subtract one or more points if the cup or tower is overturned. Under this regime, a game requiring 21 points to win will probably overturn two or three towers before 21 is reached, which provides a satisfying pattern of play. A rule requiring any win to be by 2 points (as in table tennis) adds competitive excitement towards the finish.

Optionally, a magnet or two might be placed in cup 12 prior to play, to prevent it from overturning so easily. Or the cup might be stabilized by some other means.

It would also be possible to eliminate the cup, playing the game by attempting to build a tower directly from the playing surface.

An alternate for the playing surface might be a metal to which magnets would adhere.

Coin-sized magnets work very well when playing across a table surface. Larger sizes, perhaps even approaching the diameter of dinner plates, which could be tossed across a lawn or playing field are possible.

I claim:

1. A method of playing a game with a plurality of disc-shaped magnets and a cylindrical cup having a rim, said method comprising the following steps:

placing said cup on a surface;

players taking turns attempting to toss said magnets into said cup without overturning it;

said magnets accumulating in said cup and forming a single vertical stack therein;

said stack of magnets further accumulating to rise above said rim of said cup to form a progressively growing tower;

progressive leaning and final overturning of said tower, when struck by a magnet.

2. The method of claim 1, with the additional step of scoring said game by alloting points for magnets tossed successfully onto said stack without overturning it.

3. The method of claim 1, with the additional step of subtracting points from the player whose tossed magnet overturned the cup or tower. F

* * * * *